US007997960B2

(12) United States Patent
Williams, Sr.

(10) Patent No.: US 7,997,960 B2
(45) Date of Patent: Aug. 16, 2011

(54) FLOOR RESURFACING DISK

(76) Inventor: Bruce Michael Williams, Sr., Grand Haven, MI (US)

( * ) Notice: Subject to any disclaimer, the term of this patent is extended or adjusted under 35 U.S.C. 154(b) by 926 days.

(21) Appl. No.: 11/854,952

(22) Filed: Sep. 13, 2007

(65) Prior Publication Data

US 2009/0075573 A1 Mar. 19, 2009

(51) Int. Cl.
*B24B 23/02* (2006.01)
*B24B 27/08* (2006.01)

(52) U.S. Cl. ..... 451/353; 451/350; 451/359; 451/500; 451/510

(58) Field of Classification Search ..... 451/350, 451/351, 353, 354, 359, 500, 510, 526, 548
See application file for complete search history.

(56) References Cited

U.S. PATENT DOCUMENTS 3,326,480 A * 6/1967 Jones ..... 241/298
3,631,635 A 1/1972 Vezner
3,934,377 A 1/1976 Tertinek
4,273,384 A 6/1981 Freeburn
5,054,245 A 10/1991 Coty
5,439,413 A 8/1995 Lagler
5,454,751 A 10/1995 Wiand
5,567,503 A 10/1996 Sexton et al.
5,593,342 A * 1/1997 Thibaut ..... 451/159
5,683,143 A 11/1997 Peterson et al.
6,234,886 B1 5/2001 Rivard et al.
6,238,277 B1 5/2001 Duncon et al.
6,722,955 B2 4/2004 Telischack et al.
7,033,258 B2 4/2006 Jordun
7,147,548 B1 * 12/2006 Mehrabi ..... 451/323
7,192,339 B1 * 3/2007 Harding ..... 451/487
7,226,347 B1 6/2007 Padgett et al.
7,506,644 B2 * 3/2009 Park ..... 125/22

* cited by examiner

*Primary Examiner* — Timothy V Eley
(74) *Attorney, Agent, or Firm* — Kane & Co., PLC; Barry C. Kane

(57) ABSTRACT

An abrasive disk assembly is provided for a floor resurfacing machine wherein the floor machine has at least one shaft configured to rotate about an axis substantially orthogonal to a work surface, the abrasive disk assembly including a head assembly of predetermined dimension configured to be coupled to one end of the shaft of the floor machine proximate the work surface, the head assembly including a central portion to be coupled to the shaft and a carrier portion for receiving at least one abrasive pad thereon, the carrier portion including at least one coupler in the form of a hook, a tab, a finger, a flange, and a tab extending from a peripheral edge of the carrier portion. At least one abrasive pad assembly is detachably coupled to one of the central portion and the carrier portion, and includes a first end received over the coupler and an opposite end to be attached to one of the central portion and the carrier portion.

22 Claims, 5 Drawing Sheets

FLOOR RESURFACING DISK

BACKGROUND OF THE INVENTION

1. Field of the Invention

This invention relates generally to grinding polishing or surfacing machines and more particularly to a head assembly used for retaining abrasive pads.

2. Description of the Related Art

Various scraping, grinding, and sand blasting machines have been designed over the years to resurface floors necessitated due to wear and damage to floor surfaces over long periods of repeated and continuous use. For example, painted concrete floors are often resurfaced after the existing paint becomes chipped and the floor surface becomes pitted. Carpeting, linoleum tiles, and other floor coverings are often originally secured to the floor using an adhesive to prevent movement, but these floor coverings become worn, loose, or cracked over time. When these floor coverings are taken for replacement such as by using hand scrapers and other tools, the exposed floor surface with remaining floor covering and hardened adhesive is typically very rough. Before applying a new covering to the floor such as by repainting, applying linoleum tile, carpeting, or the like, it is usually required that any remaining paint, linoleum, carpet padding, or hardened adhesive of the previous floor covering be removed by resurfacing the floor.

One type of resurfacing machine often used to resurface floors is a small, hand-held grinding machine which utilizes grinding pads. The grinding machine is moved along the floor surface by an operator from a kneeling position on the floor surface. While these grinding machines are convenient to transport to the site where the floor to be resurfaced is located, they cover only a small surface area with each pass along the floor surface and thus require considerable time to grind or sand even small areas of the floor.

Larger wheeled resurfacing machines have thus been developed which utilize larger grinding pads or cutting blades to resurface larger areas of the floor more efficiently and expediently. Such resurfacing machines typically have a wheeled chassis supporting a motor which drives a rotary floor grinding mechanism and resurfacing disk. An upstanding push handle extends from the chassis to allow the operator to stand during operation rather than kneel. Thus, these resurfacing machines cover a much larger floor area with each pass and are easier to operate than the hand-held grinding machines.

While the larger wheeled resurfacing machines are easier to operate and cover more surface area per pass than the hand-held grinders, current machines cannot operate at higher speeds. Current abrasive pad mounting designs tend to fail when the rotation rate of the grinder head is increased. Moreover, current abrasive pad designs tend to shear off from current grinder head designs when rotation speed is increased.

It is an object of this invention to provide a grinder head assembly for a resurfacing machine capable of withstanding 500 rotations per minute (RPM) and most preferably an order of magnitude greater. Moreover it is an object of the current invention to provide a grinder head capable of operating at such speeds and capable of keeping the abrasive pressure substantially consistent on the areas of greater relief than prior devices.

SUMMARY OF THE INVENTION

According to one embodiment of the invention, a floor resurfacing disk assembly is provided comprising a carrier assembly of predetermined diameter having at least one cantilevered perimeter flange, and an abrasive pad detachably mounted on said carrier assembly with one end of said abrasive pad hooked over said cantilevered perimeter flange and an opposite end detachably fastened to said carrier assembly.

In another aspect of the invention, a floor resurfacing abrasive disk assembly is provided comprising an inner carrier adapted to be coupled to a shaft of a resurfacing machine, and an outer carrier attached to said inner carrier for mounting an abrasive pad. The outer carrier includes at least one finger extending from an outer peripheral edge of the outer carrier. An abrasive pad assembly having a first end containing an aperture is received one of the fingers and a second end is detachably coupled to one of the inner carrier and the outer carrier for detachably mounting the abrasive pad to the abrasive disk assembly.

According to yet another form of the invention, an abrasive disk assembly for a floor resurfacing machine is provided where the floor machine has at least one shaft configured to rotate about an axis substantially orthogonally to a work surface. The invention includes an abrasive pad carrier assembly of predetermined dimension configured to be coupled to one end of the shaft of the floor machine proximate the work surface. The abrasive pad carrier includes a central portion to be coupled to the shaft and a carrier portion for receiving at least one abrasive pad thereon. The carrier portion includes at least one finger extending from a peripheral edge of the carrier portion. At least one abrasive pad assembly is provided for mounting on the carrier portion including one of a recess and passage in a first end of the abrasive pad assembly adapted to be received over the finger extending from the peripheral edge of said carrier portion, and a structure at an opposite end for receiving a fastener for attaching that end of the abrasive pad assembly to the abrasive pad carrier assembly.

According to another form of the invention, an abrasive pad assembly for a floor resurfacing carrier assembly having at least one peripheral hook comprises an abrasive mount having a notch defined in a first end for receiving the hook therein, and a tongue at an opposite end configured to be fastened to the resurfacing carrier assembly. One surface of the abrasive mount faces away from the floor resurfacing carrier assembly includes at least one abrasive medium thereon for contacting the floor.

According to yet another form of the invention, a carrier assembly is provided to one end of a rotating shaft of a floor resurfacing machine for receiving at least one abrasive pad assembly thereon, the invention comprising a central portion of the carrier assembly configured for attachment to the shaft and a carrier portion for receiving at least one abrasive pad thereon. The carrier portion includes at least one hook extending from a peripheral edge of said carrier portion for capturing one end of the abrasive pad assembly.

In another embodiment of the invention, a grinder head assembly is provided for attachment to one end of a rotating shaft of a floor resurfacing tool. The invention comprises a grinder head having a central portion to be interconnected to the end of the rotating shaft of the resurfacing tool. A carrier portion depends from the central portion of the grinder head and includes at least one hook member extending from a peripheral edge thereof. An abrasive pad assembly is provided having an abrasive material on a surface facing away from the grinder head, a notch defined at a first end of said abrasive pad assembly for receiving the hook member extending from said peripheral edge of said carrier portion, and a tongue at an opposite end of said abrasive pad assembly provides a means for fastening the abrasive pad to one of the central portion and the carrier portion of the grinder head.

The advantages offered by the different forms and embodiments of the invention include an efficient method for replacing pads used to abrade the surface of a floor. Moreover, the invention provides for a more compact abrasive pad, permitting for a larger grinding surface area. In addition, the compact nature of the attachment means for the abrasive pad allows one to build a resurfacing machine with substantially smaller distances between the abrasive pad and the perimeter of the machine, allowing the operator to resurface the floor much closer to obstructions such as wall, plumbing and the like.

These and other objects, advantages, purposes and features of the invention will become more apparent from a study of the following description taken in conjunction with the drawing figures described below.

BRIEF DESCRIPTION OF THE DRAWING FIGURES

DETAILED DESCRIPTION OF THE DIFFERENT EMBODIMENTS

For purposes of the following description, the terms "upper," "lower," "right," "left," "rear," "front," "vertical," "horizontal," and derivatives and synonyms thereof shall relate to the invention as displayed in the respective figure referenced in that portion of the detailed description. However, it is to be understood that the invention may assume various alternative orientations, except where expressly specified to the contrary. It is also to be understood that the specific devices and processes illustrated in the attached drawings and described in the following specification are simply exemplary embodiments of the inventive concepts defined in the appended claims. Specific dimensions and other physical characteristics relating to the embodiments disclosed herein are not to be considered as limiting, unless the specification and claims expressly state otherwise.

Figure 1:
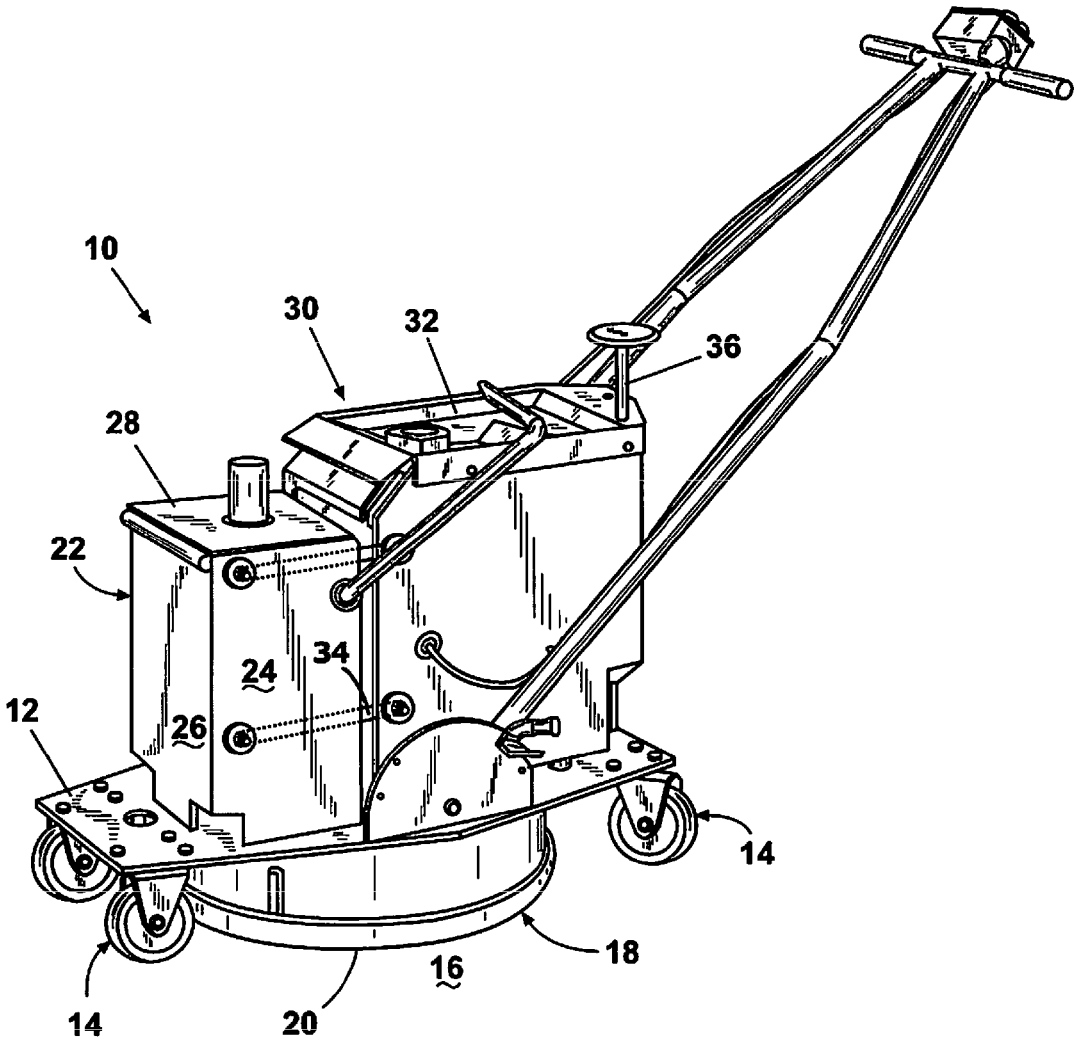
FIG. 1 is an oblique view (or side view) of one embodiment of a floor resurfacing machine.

Referring now to the drawing figures and in particular FIG. 1, one embodiment of a floor resurfacing machine 10 is depicted that may be used in conjunction with the present invention. The floor resurfacing machine includes a chassis 12 mounted on a plurality of castors 14 for moving the machine 10 over the work surface or floor 16. Depending from the chassis 12 is an apron or shroud 18 having a lower lip 20 disposed a predetermined distance above the work surface or floor 16.

Disposed on the upper surface of the chassis 12 proximate a front end of the machine 10 is a frame 22. The frame 22 may be formed by a plurality of wall sections 24 interconnected to form a semi-enclosed upright structure having an open side. Interconnected to the frame 22 yet suspended above the chassis 12 is a grinder assembly 30. The grinder assembly 30 includes a housing 32 connected to the frame 22 by a four-bar linkage lift assembly 34, and at an opposite end by a down-pressure mechanism 36. The four-bar linkage lift assembly 34 keeps the grinder assembly 30 oriented at a predetermined angle relative to the chassis 12. In a preferred embodiment, the four-bar linkage permits parallel translation of the grinder assembly 30 in a vertical direction relative to the floor, substrate or work surface 16. An eccentric cam attached to one end of a rotating handle and positioned beneath one of the links comprising the four-bar linkage system is used to raise and lower the housing 32.

Mounted within the housing 32 in a first embodiment of the machine 10 is an electric motor attached to one of the sidewalls of the housing 32. Also mounted within the housing is a main shaft assembly 40 extending downwardly from the housing 32 and into the shroud or apron 18. The main shaft assembly 40 is preferably supported by a shaft housing assembly 42 attached to a lower end of the housing 32 and extending into the shroud or apron 18. The main shaft assembly 40 includes a shaft 44 journaled within the shaft housing assembly 42 by a plurality of bearings and held by snap rings or other shaft keepers to keep the shaft from dropping out of the main shaft assembly 40. The upper end of the shaft 44 extending into the housing 32 is fitted with a sheave of predetermined dimension. A second sheave of predetermined dimension is also attached to the end of the shaft extending from the motor. The two sheaves are aligned to receive a belt kept tight there between by a belt tensioner and an idler pulley.

Figure 2:
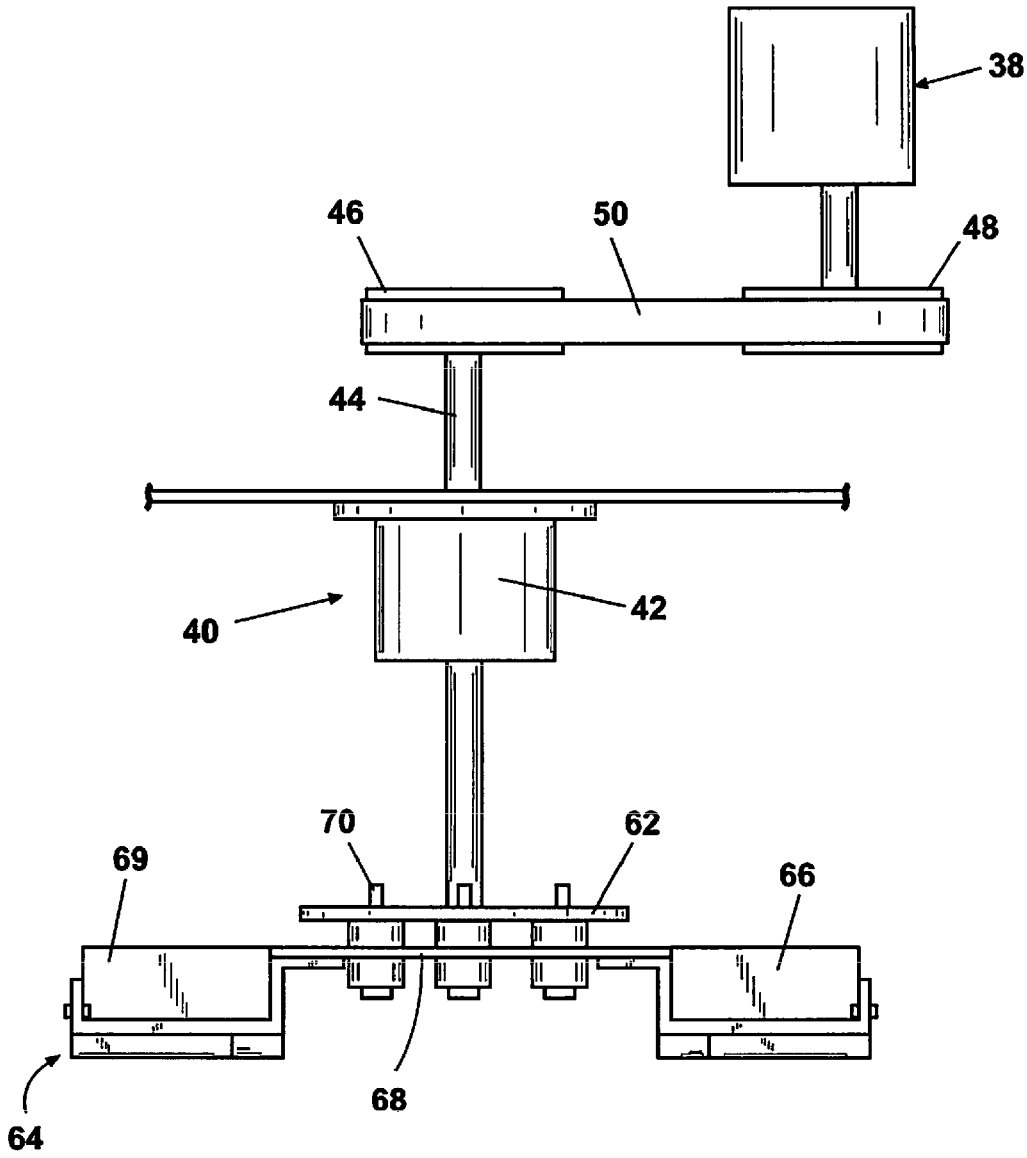
FIG. 2 is a schematic view of the components of the floor resurfacing machine shown in FIG. 1.
Figure 3:
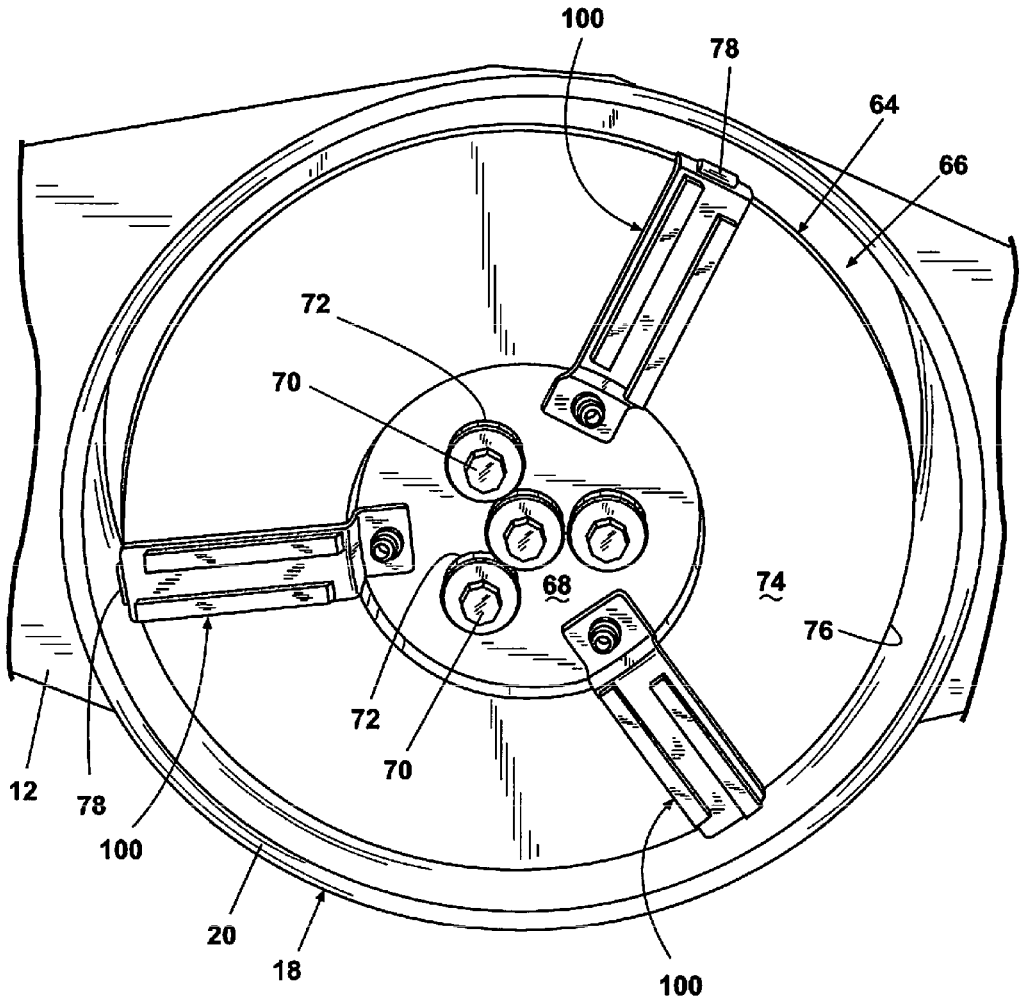
FIG. 3 is an oblique view of one embodiment of a head assembly used in conjunction with the floor resurfacing machine shown in FIG. 3.

Referring now to FIGS. 2 and 3, the lower end of the shaft 44 includes a flange 62. Attached to flange 62 is a grinder head assembly 64. In a one embodiment, the grinder head assembly 64 may include a substantially disk- or plate-shaped carrier 66 comprised of an inner plate or carrier member 68 interconnected to the shaft flange 62 by a plurality of bolts or other fasteners 70. In a preferred embodiment a plurality of grommets 72 are positioned between the heads of the fasteners 70 and the inner carrier member 68 and between the inner carrier member 68 and the shaft flange 62 to provide some range or motion relative to one another and to keep substantially equal force upon the grinder head assembly 64 when encountering uneven work or floor surfaces.

Depending from the inner carrier member 68 is an outer carrier member 74 formed by at least one annulus-like plate or ring concentric with the inner carrier member as well as the rotation axis of the shaft 44. The annulus-like outer carrier member 74 may be vertically offset and lower with respect to the inner carrier member 68 by a plurality of bulkheads 69 for reasons that will become apparent below. The outer peripheral edge or end 76 of the outer carrier member or annulus 74 includes at least one, and preferably a plurality of radially extending cantilevered flanges, hooks or tangs 78 extending a predetermined distance beyond the peripheral edge 76. Each cantilevered flange, hook or tang 78 may lie in substantially the same plane and parallel to the plane containing the outer carrier member 74 described above.

Figure 4:
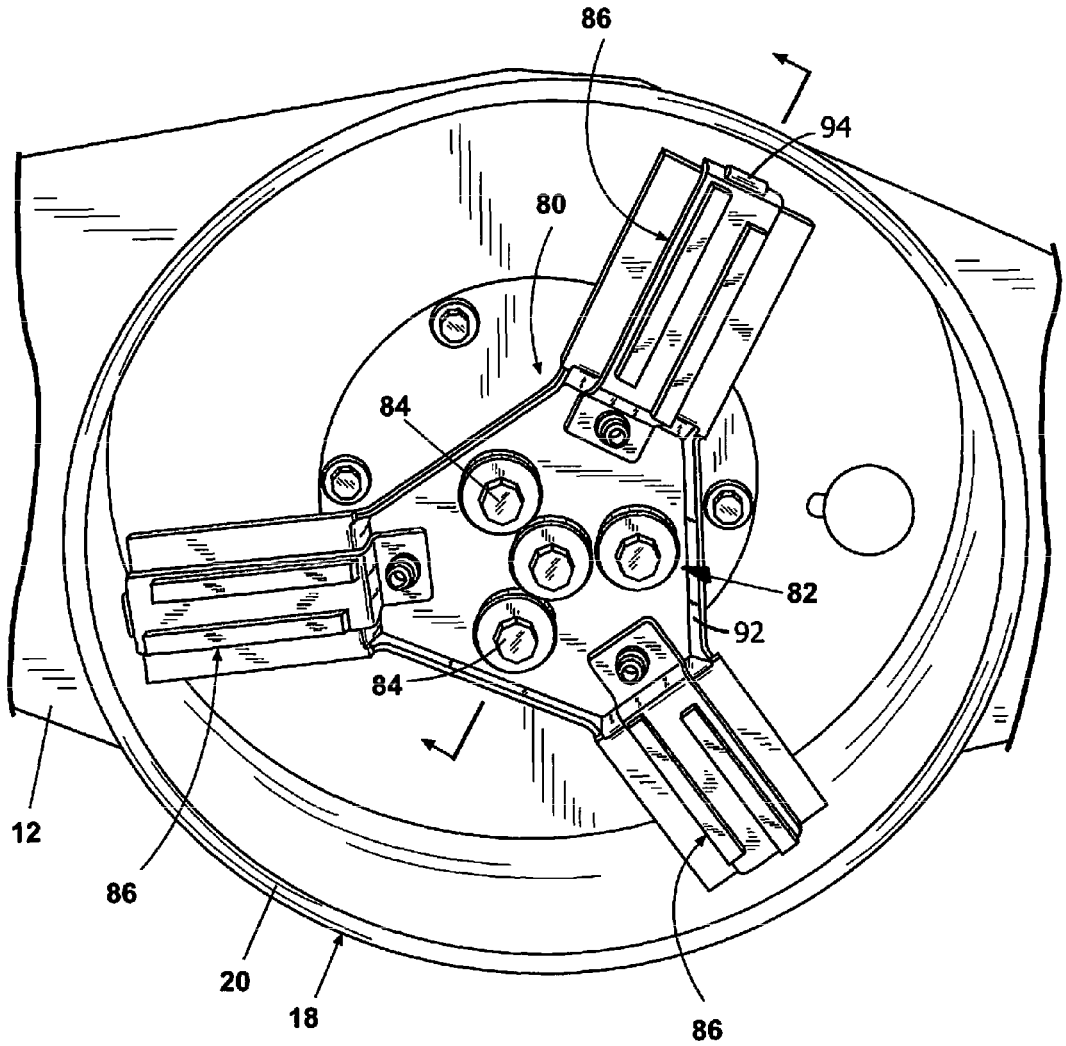
FIG. 4 is an oblique view of another embodiment of a head assembly used in conjunction with the floor resurfacing machine shown in FIG. 3.
Figure 5:
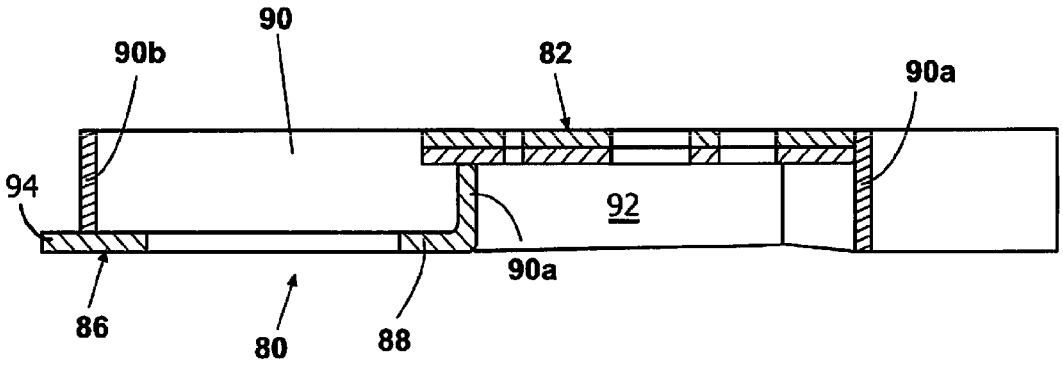
FIG. 5 is a cross section view of the head assembly taken along line V-V shown in FIG. 4.

A preferred embodiment of the grinder head assembly 80 is shown in FIGS. 4 and 5. The grinder head assembly 80 includes a central hub or inner carrier member 82 to be interconnected to the flange 62 of the shaft 44. As in the previous embodiment, it is preferred that grommets or similar resilient members be disposed between the hub 82 and the flange 62 of the shaft 44 as well as between the head of the fasteners 84 and the hub 82 so that the hub 82 may float and move relative to the shaft flange 62 when uneven surfaces are encountered on the work surface or floor 16. Depending from the hub 82 and radially extending outwardly there from are a plurality of outer carriers 86 each rigidly attached to the hub 82. Each outer carrier includes a plate 88 which is disposed in a plane parallel to that containing the hub 82, but is laterally offset there from by a predetermined distance in a direction toward the work surface or floor 16 when mounted on the machine 10. Each plate 88 includes a plurality of orthogonal yet interconnected wall members 90 to provide rigidity and strength to the plate 88. One of the walls 90*a* proximate the hub 82 is welded to the hub 82 as well as the surrounding bulkheads 92 depending from the hub 82 to reinforce each radially extending outer carrier 86. Extending from a distal end 92 of each outer carrier 86 relative to the hub 82 is a flange, hook, tang or tab 94 which may be an extension of the plate 88 or the distal wall member 90*b*.

Figure 6:
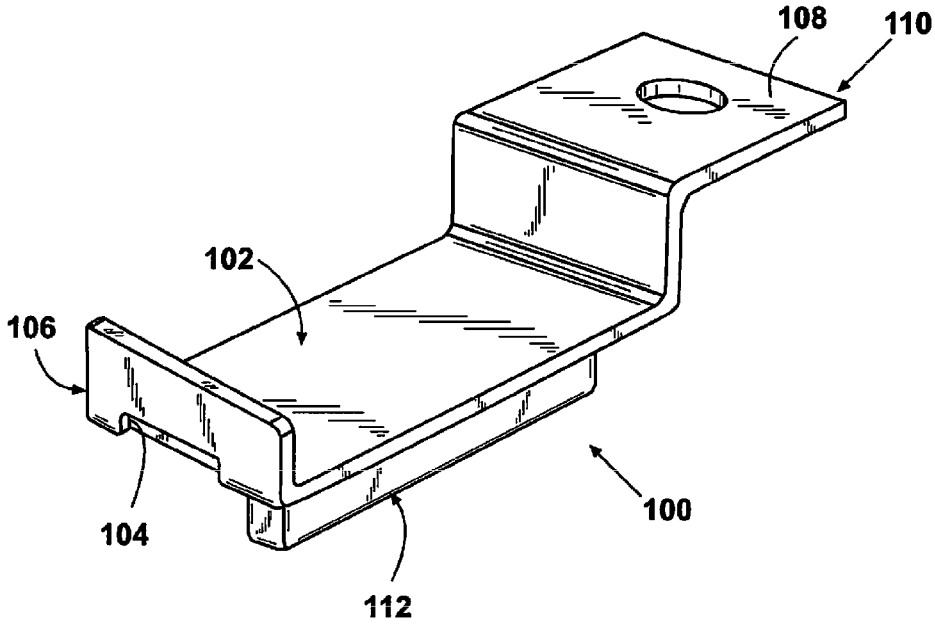
FIG. 6 is an oblique view an abrasive pad to be used in association with either one of the head assemblies shown in FIGS. 3 and 4.

In a preferred embodiment of the invention, an abrasive pad 100 shown in FIG. 6 is received upon the outer carriers 74, 86 described above and attached thereto. Each abrasive pad 100 includes a generally C-shaped mount 102 having a notch 104 defined in a first end 106 for receiving one of the flanges, hooks, tangs or tabs 78, 94, and a tongue 108 at an opposite end 110 configured to be fastened to the hub or inner carrier member 68, 82. Attached to a surface of mount 102 facing the floor or work surface includes an abrasive medium 112 thereon for contacting the floor. The abrasive medium 112 may be of substantially any desired dimension, but in a preferred embodiment, there are two strips of abrasive 112*a*, 112*b* attached to the mount 102 in spaced apart and staggered relationship to one another in order to provide a maximum area of overlap when in contact with the floor or work surface 16 and a moderate to minimal amount of feather towards the ends.

In operation, it is of no important significance whether the grinder head assembly be attached to the flange of the shaft before or after having each of the abrasive pads attached thereto. Indeed, one of the objects of the invention is to provide a abrasive pad that can be easily removed and replaced on the grinder head assembly while the grinder head assembly is mounted on the resurfacing machine. In practice the abrasive pads 100 may be pre-attached to the grinder head assembly. The user may take the complete grinder head assembly and attach it to the flange of the shaft by inserting a plurality of bolts through the mounting holes and the respective grommets. In this configuration the grommets permit some degree of flexural movement of the grinder head about one or more of the fasteners.

To attach one of the abrasive pads 100 to either one of the forms of the grinder head assemblies described above, the user only need to slide the notched end 106 of the mount 102 over the hook, flange, and tongue or tab 78 extending from the peripheral edge of the respective grinder head assembly. The web or central portion of each mount lies flush against the one surface of the outer carrier member so that the abrasive medium attached to the opposite side of the mount is supported and prevented from bending moments or flexing. The second or opposite end 110 of the mount 102 is rigidly yet detachably fixed to one of the inner or outer carriers members by a bolt or other removable fastener of sufficient strength to anchor the opposite end of the mount 102.

One aspect of the invention is the strength offered by the hook, tongue, tab or flange extending from the peripheral edge of the grinder head assembly as well as the ability of the notched end of the mount to withstand torsional and shear forces exerted thereon during operation of the machine.

In a preferred embodiment of the invention, the grinder head assembly and the mounts 102 for the abrasive pads 100 are made from one-eighth inch thick plate steel. The dimensions of the tabs, hooks, flanges or tabs such as designated by numeral 78 are made from the same plate steel and may be on the order of three-quarters of an inch wide, one-quarter of an inch long, and one-eighth of an inch thick. The inside dimension of the notch 104 formed in the first end of the mount 102 is of substantially similar length and height as that of the tab or flange 78 so that very little lash occurs when the two components are coupled together.

In operation the abrasive pads 100 are mounted on one of the respective embodiments of grinder head assemblies described above in the manner described so that the abrasive medium attached to the mount 102 is in the preferred orientation for contacting the work surface or floor to be treated. Moreover, the grinder head assembly is attached in the appropriate manner to the flange 62 of the main shaft assembly 40 so that power transmitted through the motor or engine mounted on the grinder is transferred to rotary action of the main shaft assembly 40. The rotation of the main shaft assembly 40 is then imparted to the grinder head assembly such as 64. The abrasive pads 100 engage the work surface or floor 16 by lowering the grinder assembly 30 with respect to the chassis 12. In the embodiment of the floor resurfacing machine described herein, the down pressure or force of the abrasive pads 100 against the work surface 16 is achieve by the weight of the grinder assembly 30 itself. Additional weight of the floor resurfacing machine may be added to that of the grinder assembly 30 by use of the down pressure mechanism 36 which is attached to the chassis 12 when the distance between the end of the threaded rod 56 and the adjustment knob 60 is shortened.

Although the invention has been described as the abrasive pad assembly 100 having a notch for receiving a tab extending from a peripheral edge of the carrier, it is also contemplated that structures may be reversed. More particularly it is contemplated that one of ordinary skill in the art may achieve substantially the same function in substantially the same way to achieve substantially the same result by designing the carrier to have a notch or aperture that is intended to receive a tab extending from the abrasive pad assembly for retaining one end of the abrasive pad assembly on the carrier. For example it is contemplated that the first end 106 of the mount 102 may be C-shaped rather than the L-shape shown in the drawing figures, where the upper leg of the C-shaped end may lie above the mount and be received within a slot formed in the distal end of the carrier. Other reversal of components can be made to achieve substantially the same function described above.

The abrasive medium attached to the surface of the abrasive pad mount 102 may vary, depending upon the nature of the work be to done on the work surface 16. As the type of abrasive material varies, so does the specific type of mechanism for bonding the abrasive medium to the mount 102. The specific type of abrasive medium is not considered crucial to the invention described above nor the mechanism for bonding the medium to the abrasive pad.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents. The embodiments of the invention in which an exclusive property or privilege is claimed are defined below.

Having now described the features, discoveries and principles of the invention, the manner in which the invention is constructed and operated, the characteristics of the invention, and the advantageous, new and useful results obtained: the new and useful structures, devices, elements, arrangements, parts and combinations are set forth in the appended claims.

The invention claimed is:

1. A floor resurfacing disk assembly comprising: a carrier assembly of predetermined diameter having at least one cantilevered perimeter flange; and an abrasive pad detachably mounted on said carrier assembly with one end of said abrasive pad hooked over said cantilevered perimeter flange and an opposite end of said abrasive pad detachably fastened to said carrier assembly.

2. The floor resurfacing disk assembly as defined in claim 1, further comprising a resilient member on said carrier assembly.

3. The floor resurfacing disk assembly as defined in claim 1, wherein said carrier assembly comprises a hub member for attaching said carrier assembly to a floor resurfacing machine, and a carrier member attached to said hub member and in a plane offset yet parallel to said hub member.

4. The floor resurfacing disk assembly as defined in claim 1, wherein said carrier assembly comprises a hub member for attaching said carrier assembly to a floor resurfacing machine, and a plurality of carrier members radially extending from said hub member and spaced equidistantly from one another.

5. The floor resurfacing disk assembly as defined in claim 1, wherein said abrasive pad comprises a mount having a notched first end for receiving said cantilevered perimeter flange, and a second end of said mount to be attached to said carrier assembly.

6. A grinder head assembly for a resurfacing machine, comprising: an inner carrier adapted to be coupled to a shaft of a resurfacing machine; and at least one outer carrier attached to said inner carrier, said outer carrier including at least one tab extending from an outer peripheral edge of said outer carrier; and an abrasive pad assembly having a first end containing an aperture received over said tab and a second end detachably coupled to one of said inner carrier and said outer carrier for detachably mounting said abrasive pad to the grinder head assembly.

7. The grinder head assembly as defined in claim 6, wherein said inner carrier is concentrically disposed with respect to said outer carrier.

8. The grinder head assembly as defined in claim 7, wherein said inner carrier comprises a hub for attaching the grinder head assembly to a resurfacing machine.

9. The grinder head assembly as defined in claim 7, wherein said outer carrier comprises a plurality of outer carrier members extending radially outward at predetermined locations from said inner carrier.

10. The grinder head assembly as defined in claim 7, wherein said outer carrier comprises a plurality of outer carrier members spaced equidistantly from one another around said inner carrier.

11. The grinder head assembly as defined in claim 6, wherein said inner carrier and said out carrier are in dissimilar planes.

12. The grinder head assembly as defined in claim 6, wherein said outer carrier extends radially outward from said inner carrier.

13. The grinder head assembly as defined in claim 6, wherein said abrasive pad assembly comprises a mount having a notch in a first end for receiving said at least one tab, and a second end for attachment to one of said inner carrier, and said outer carrier.

14. The grinder head assembly as defined in claim 6, wherein said abrasive pad assembly comprises a mount having one of a notch and a tab defined at a first end for receiving one of a notch and a tab defined on said outer carrier, and a tongue at a second end of said mount for attachment to one of said inner carrier and said outer carrier.

15. An abrasive disk assembly for a floor resurfacing machine, the floor resurfacing machine having at least one shaft, comprising: a head assembly to be coupled to one end of the at least one shaft of the floor resurfacing machine, said head assembly including a central portion to be coupled to the shaft, a carrier portion attached to said central portion, said carrier portion including a peripheral edge, at least one of a hook, a tab, a finger, and a flange extending from said peripheral edge of said carrier portion; at least one abrasive pad assembly detachably coupled to one of said central portion and said carrier portion including a first end received over said one of said hook, tab, finger, and flange extending from said peripheral edge of said carrier portion, and an opposite end of said abrasive pad attachable to one of said central portion and said carrier portion.

16. An abrasive pad for a floor resurfacing machine, comprising a mount having a notch defined in a first end for receiving a tab extending from a peripheral edge of a grinder head, and a tongue at an opposite end configured to be fastened to said grinder head, a surface of said mount facing away from the grinder head having at least one abrasive medium thereon for contacting the floor, said mount comprises a central web portion having a first end and a second end, said first end including a leg member extending away from said web portion at a predetermined angle, and said second end including a tongue portion substantially parallel to said web portion.

17. An grinder head assembly for a surfacing machine, comprising: a central portion to be attached to one end of a spinning shaft and a carrier portion for receiving at least one abrasive pad thereon, said carrier portion comprising an annulus surrounding said central portion; and at least one tab extending from said annulus for capturing one end of said abrasive pad.

18. The grinder head assembly as defined in claim 17, wherein said carrier portion depends from and is parallel to said central portion.

19. The grinder head assembly as defined in claim 18, wherein said carrier portion is disposed concentrically around said central portion.

20. The grinder head assembly as defined in claim 18, wherein said carrier portion comprises a plurality of carrier members extending radially outward from said central portion.

21. The grinder head assembly as defined in claim 20, wherein said carrier portion and said central portion are in dissimilar planes.

22. An abrasive disk assembly for a floor resurfacing machine, comprising: a head assembly having a central portion and a carrier portion, said carrier portion including a peripheral edge; at least one of a hook, a tab, a finger, and a flange cantilevered from said peripheral edge; and at least one abrasive pad assembly having one end detachably coupled to one of said central portion and said carrier portion and an opposite end received over one of said hook, tab, finger, and flange.

* * * * *